US009810004B2

(12) United States Patent
Scholz et al.

(10) Patent No.: US 9,810,004 B2
(45) Date of Patent: Nov. 7, 2017

(54) MOTOR VEHICLE DOOR LOCK

(75) Inventors: Michael Scholz, Essen (DE); Johannes-Theodor Menke, Velbert (DE); Werner Pohle, Dortmund (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 175 days.

(21) Appl. No.: 14/001,923

(22) PCT Filed: Feb. 24, 2012

(86) PCT No.: PCT/DE2012/000195

§ 371 (c)(1),
(2), (4) Date: Nov. 4, 2013

(87) PCT Pub. No.: WO2012/116686

PCT Pub. Date: Sep. 7, 2012

(65) Prior Publication Data

US 2014/0049056 A1 Feb. 20, 2014

(30) Foreign Application Priority Data

Feb. 28, 2011 (DE) ..... 10 2011 012 656

(51) Int. Cl.
*E05C 3/06* (2006.01)
*E05B 81/04* (2014.01)
(Continued)

(52) U.S. Cl.
CPC ..... *E05B 81/04* (2013.01); *E05B 81/14* (2013.01); *E05B 81/20* (2013.01); *E05B 85/243* (2013.01);
(Continued)

(58) Field of Classification Search
CPC ..... E05B 77/20; E05B 81/14; E05B 81/20; E05B 81/21; E05B 85/243; E05B 81/04;
(Continued)

(56) References Cited

U.S. PATENT DOCUMENTS 4,986,579 A * 1/1991 Ishikawa ..... 292/201
5,411,302 A * 5/1995 Shimada ..... 292/201
(Continued)

FOREIGN PATENT DOCUMENTS

DE 3744135 A1 * 7/1988
DE 3836771 A1 * 1/1990
(Continued)

OTHER PUBLICATIONS

Machine translation of WO 2010034294.*
Machine translation of WO 2010034296.*

*Primary Examiner* — Kristina Fulton
*Assistant Examiner* — Christine M Mills
(74) *Attorney, Agent, or Firm* — Renner, Otto, Boisselle & Sklar, LLP

(57) ABSTRACT

A motor vehicle door lock comprising a locking mechanism (1, 2) and a closing/opening device (7 to 16) with at least one drive (7 to 11 and 13, 14), at least one transfer element (12, 15) and a driving pawl (16), in which the drive acts on the driving pawl with the assistance of the transfer element to open and close the locking mechanism, wherein a mechanical and/or electrical opening drive (7 to 11) and a mechanical and/or electrical closing drive (13, 14) each with a respective opening transfer lever (12) and closing transfer lever (15) are provided, in which the opening drive (7 to 11) including the opening transfer lever (12) in addition to the opening function for the locking mechanism (1, 2) is also designed to interrupt a closing function initiated by the closing drive (13, 14) in connection with the closing transfer lever (15).

9 Claims, 3 Drawing Sheets

(51) Int. Cl.
*E05B 81/14* (2014.01)
*E05B 81/20* (2014.01)
*E05B 85/24* (2014.01)

(52) U.S. Cl.
CPC ..... *E05B 81/21* (2013.01); *Y10S 292/23* (2013.01); *Y10T 292/108* (2015.04); *Y10T 292/1047* (2015.04); *Y10T 292/1082* (2015.04)

(58) Field of Classification Search
CPC ..... Y10T 292/108; Y10T 292/1082; Y10T 292/1047; Y10S 292/23
USPC ..... 292/201, 216, DIG. 23, 200
See application file for complete search history.

(56) References Cited

U.S. PATENT DOCUMENTS

| | | | | |
|---|---|---|---|---|
| 5,516,164 | A * | 5/1996 | Kobayashi | 292/201 |
| 5,639,130 | A * | 6/1997 | Rogers et al. | 292/216 |
| 6,422,615 | B1 * | 7/2002 | Roos et al. | 292/216 |
| 6,471,259 | B1 * | 10/2002 | Weyerstall et al. | 292/201 |
| 6,550,825 | B2 * | 4/2003 | Ostrowski et al. | 292/199 |
| 6,557,910 | B2 * | 5/2003 | Amano | 292/201 |
| 7,029,039 | B2 * | 4/2006 | Rathmann et al. | 292/199 |
| 7,390,034 | B2 * | 6/2008 | Inoue | 292/10 |
| 8,033,584 | B2 * | 10/2011 | Akizuki et al. | 292/216 |
| 8,109,542 | B2 * | 2/2012 | Okada et al. | 292/201 |
| 8,757,681 | B2 * | 6/2014 | Graute | 292/201 |
| 8,757,682 | B2 * | 6/2014 | Scholz et al. | 292/201 |
| 2004/0056489 | A1 * | 3/2004 | Boecker et al. | 292/201 |
| 2005/0082842 | A1 * | 4/2005 | Warmke et al. | 292/216 |
| 2006/0267350 | A1 * | 11/2006 | Ichinose et al. | 292/201 |
| 2008/0224482 | A1 * | 9/2008 | Cumbo et al. | 292/216 |
| 2015/0021934 | A1 * | 1/2015 | Barmscheidt et al. | 292/336.3 |

FOREIGN PATENT DOCUMENTS

| | | | | |
|---|---|---|---|---|
| DE | 4319122 | C1 * | 10/1994 | |
| DE | 29612524 | U1 * | 10/1996 | |
| DE | 19933371 | A1 * | 2/2000 | |
| DE | 10164438 | A1 | 7/2003 | |
| DE | 10216845 | A1 | 11/2003 | |
| DE | 102004052599 | A1 | 5/2006 | |
| DE | 102006024203 | A1 | 11/2006 | |
| DE | 102005048564 | A1 | 4/2007 | |
| DE | 202008007310 | U1 | 6/2009 | |
| DE | 102008048772 | A1 | 3/2010 | |
| DE | 202008015789 | U1 * | 4/2010 | E05B 81/20 |
| DE | 202013102505 | U1 * | 8/2013 | |
| DE | 202012010338 | U1 * | 3/2014 | |
| EP | 0745746 | A1 | 12/1996 | |
| EP | 1243725 | A2 * | 9/2002 | |
| EP | 1319780 | A1 * | 6/2003 | |
| FR | 2850698 | A1 * | 8/2004 | |
| JP | 1994-294245 | A | 10/1994 | |
| JP | 2000-27511 | A | 1/2000 | |
| JP | 2006-316415 | A | 11/2006 | |
| WO | WO 2009056119 | A2 * | 5/2009 | |
| WO | WO 2010034294 | A1 * | 4/2010 | |
| WO | WO 2010034296 | A1 * | 4/2010 | |

* cited by examiner

MOTOR VEHICLE DOOR LOCK

CROSS REFERENCE TO RELATED APPLICATIONS

This application claims priority under 35 U.S.C. 119 and 35 U.S.C. 365 based upon German Patent Application No. 10 2011 012 656.2, filed on Feb. 28, 2011. The entire disclosure of the aforesaid application is incorporated herein by reference.

FIELD OF THE INVENTION

The invention relates to a motor vehicle door lock, which is equipped with a locking mechanism and a closing/opening device with at least one drive and at least one transfer element and a driving pawl, in which the drive with the aid of the respective transfer element acts on the driving pawl to open or close the locking mechanism.

BACKGROUND OF THE INVENTION

A motor vehicle door lock of the above-mentioned design is, for instance, disclosed in utility patent DE 20 2008 015 789 U1. Closing devices for motor vehicle doors are usually used for moving, for instance, a motor vehicle door from its intermediate locking position into its main locking position. During this process considerable counterforces normally have to be overcome, which are generally applied during this process by compressed rubber door seals. With the aid of the generally electrically actuated closing device, the closing operation is particularly comfortable and simple.

Furthermore, opening devices are known that generally ensure the opening of a locking mechanism. Such opening aids are, for instance, disclosed in DE 10 2004 052 599 A1 in which reference is made to the also relevant DE 20 2008 007 310 U1. In the simplest case, such opening devices or opening aids use an electric drive, lifting a pawl off a rotary latch of a closed locking mechanism. As a result, the rotary latch can be opened with the aid of a spring and a previously engaged locking bolt, thus releasing the entire respective motor vehicle door.

Closing devices or closing aids often have the problem of so-called emergency interruption, as disclosed in the aforementioned DE 20 2008 015 789 U1. Such an emergency interruption is, amongst others, required when the closing operation is to be cancelled. Examples for such scenarios are where an operator's finger or hand enters the door gap to be closed. Or in case, where for instance a coat of the operator gets stuck in the door gap.

In all of these emergency interruption cases, the closing operation must be stopped, where possible, without delay and in a reliable manner and, in the most favorable case, the door should be opened or released at the same time. For this purpose, DE 20 2008 015 789 suggests a procedure in which the closing/opening device with its transfer element blocks the movement and does not activate the locking mechanism. In this way a stop interacting with the transfer element ensures that in the described blocking case a part of the generated blocking force is transferred directly onto the stop. As a result, the overall force acting between the driving pawl and the locking mechanism is reduced.

Generally, the driving pawl or closing pawl acts directly or indirectly on the rotary latch. As soon as the rotary latch is in the intermediate locking position, the driving pawl is acted upon by a motor in such a way that the rotary latch is moved from the intermediate locking position into the main locking position. This is naturally only one example.

In practical application more and more motor vehicle door locks are used that are or should be equipped with a closing aid and an opening aid. On one hand this is because of higher comfort requirements and, on the other hand, due to the fact that such aids are becoming increasingly cheaper due to the already high numbers of devices produced and have thus become a mass product. Such motor vehicle door locks do, however, have a relatively complicated design, in particular where they should also provide the option of providing an emergency interruption of the closing operation. The invention aims to remedy this situation.

SUMMARY OF THE INVENTION

The invention is based on the technical problem of further developing such a motor vehicle door lock is such a way that the complexity of the construction as a whole is reduced and synergy effects can be used.

To solve this technical problem, a generic motor vehicle door lock of the invention is characterized by a mechanical and/or electrical opening drive and a mechanical and/or electrical closing drive, each containing an associated opening transfer lever and a closing transfer lever, in which the opening drive including the opening transfer lever is designed, apart from providing the opening function for the locking mechanism also to interrupt a closing function initiated by the closing drive in connection with the closing transfer lever.

The invention thus uses an opening drive as well as a closing drive so that the general functional states of an opening function and a closing function can be provided. The opening function is generally carried out mechanically and/or electrically. In the latter case, this is also referred to as "electric opening". The closing function is, on the other hand, normally only electric.

As part of the invention, the interruption of the closing function in connection with an emergency interruption is provided by the opening drive. This means that for producing the emergency interruption the invention requires no additional devices or drives but instead this is produced by the existing opening drive. In this context, the closing function can be mechanically and/or electrically interrupted. In the first case, the opening drive produces a mechanical actuation, ensuring that the closing function is interrupted. In the latter version the electric opening drive, "EO" ensures the interruption of the closing function.

In this way, the overall complexity is reduced and synergy effects between the drives can be used, in this case for the emergency interruption of the closing function. This reduces manufacturing costs and increases functional reliability.

To achieve this in detail, the opening drive disengages the closing pawl with the opening transfer lever to interrupt the closing function. The closing pawl generally engages with a rotary latch of the locking mechanism. As soon as the locking mechanism has assumed a certain closed position, for instance the intermediate locking position, the closing drive is activated and ensures through the closing pawl that the rotary latch is moved from its current closed position into the main locking position.

In this way not only a comfortable closing operation is provided but overall reliability is also increased, as the invention ensures that a motor vehicle door interacting with the motor vehicle door lock is transferred in any case into its main locking position and that thus, in case of an accident, all safety devices inside the motor vehicle door can become effective as planned.

In order to interrupt the described closing operation or the closing function for instance as part of an emergency interruption in case of a jammed coat, finger, hand, etc., the opening drive ensures that with the aid of the opening transfer lever assigned to the opening drive the closing pawl is disengaged. The disengaged closing pawl is now not (no longer) able to act upon the rotary latch or close it. Instead, the rotary latch is released from the closing pawl and can be pivoted into its open position with the aid of a spring. A previously engaged locking bolt is released. The same applies for the associated motor vehicle door.

To achieve this in detail, the arrangement contains an ejector lever. The ejector lever is actuated upon by the opening transfer lever to eject the closing pawl. For this purpose, the ejector lever is interposed between the opening transfer lever and the closing pawl. As soon as the ejector lever is pivoted by the opening transfer lever, it ensures that the closing pawl is lifted off the rotary latch.

In this context the invention also suggests that the ejector lever is mounted on the same axis as the closing pawl. It is advantageous for the ejector lever and the closing pawl to both be mounted on the closing transfer lever. The closing transfer lever, in turn, is connected to the closing drive. As soon as the closing drive is acted upon, the closing transfer lever is pivoted.

As a result, the closing pawl is also pivoted and ensures, in turn, that the rotary latch is closed, as described. The closing drive can act upon the closing transfer lever mechanically and/or electrically thus ensuring the described pivoting. The closing transfer lever can be mounted on the same axis as the rotary latch, resulting in an overall compact arrangement.

The opening transfer lever contains at least two arms including a drive arm and an actuating arm. The drive arm interacts with the opening drive. The actuating arm, on the other hand, provides the actuation of the closing pawl. For this purpose, the actuating arm regularly acts upon the already described ejector lever and therefore on the closing pawl or directly on the closing pawl.

In most cases, an electrical as well as a mechanical opening drive is provided. The opening transfer lever can, in this context, interact with a drive wheel of the electrical opening drive. For this purpose, the drive wheel contains in most cases a cam actuating the opening transfer lever.

Rotations of the electrical opening drive or of the drive wheel acted upon by said electrical opening drive are now translated by the cam into a pivoting movement of the opening transfer lever. As soon as the opening transfer lever is pivoted on its drive arm, its actuating arm ensures that the ejector lever is being acted upon. The acted upon ejector lever in turn ensures that the closing pawl previously engaged with the rotary latch is lifted off the said latch.

In addition to the described electrical opening drive a mechanical opening drive is provided for the opening transfer lever. This mechanical opening drive can engage into a connecting arm of the opening transfer lever. In most cases a coupling element is provided that connects the opening transfer lever or its connecting arm to the mechanical opening drive. The mechanical opening drive can be designed as a lever, concealed handle, etc. A mechanical connection to the internal and/or external door handle is also possible.

In any case an actuation of the lever or of the respective door handle or of the mechanical opening drive ensures that the opening transfer lever is pivoted again and in such a way that the opening transfer lever removes the closing pawl from the rotary latch with its actuating arm. To achieve this, the actuating arm acts on the ejector lever which, in turn, ejects the closing pawl.

In order to provide these different functional statuses in detail, the opening transfer lever advantageously contains an actuating element. This actuating element ensures that in the opening function, a pawl is lifted off the rotary latch of the locking mechanism. This is the normal functionality during the so-called electrical opening "EO" and during the mechanical opening process. As soon as the opening transfer lever is mechanically and/or electrically pivoted (and the closing function rests), the actuating element ensures that the pawl is being lifted off the rotary latch. As a result, the rotary latch can move into its open position with the aid of a spring and can release the previously engaged locking bolt. A motor vehicle door housing the locking bolt can be opened.

As part of the invention, the said actuating element is now also designed to interrupt the closing function. For this purpose, the actuating element interacts with the closing pawl and/or the ejector lever upstream of the closing pawl to interrupt the closing function.

For this purpose, the actuating element is regularly designed as an actuating journal. During an interruption of the closing function this actuating journal acts upon the ejector lever. In this way the closing pawl is disengaged from the rotary latch. At the same time, the actuating element or the actuating journal ensures that the pawl is lifted off the rotary latch.

The interruption of the closing function is therefore functionally connected by this dual functionality of the actuating element or of the actuating journal as the pawl is lifted off the rotary latch at the same time. In other words, during the closing operation with the aid of the closing pawl, the closed rotary latch is not only mechanically released from the shutting closing pawl but also the spring-assisted opening operation of the rotary latch is not impeded during this process. This is because the actuating element or the actuating journal ensures at the same time that the pawl is lifted off the rotary latch as part of the "electrical opening".

As a result, the rotary latch can, during the interruption of the closing function, be freely pivoted from its initial closed position into its open position by means of a spring and the previously engaged motor vehicle door is released.

As already explained, the opening drive contains, for instance, an additional lever in the passenger compartment with a door handle, etc. for its mechanical actuation. In addition, also an electric switching element is often provided in the passenger compartment or close to the passenger compartment, in order to act upon the electrical opening drive as desired. This electrical switching element is typically deployed during the "electric opening" operation. Equally, the electric switching element provides the described emergency interruption of the closing function when required. The same applies for the lever. The respective lever and the electrical switching element can be used as an alternative to each other.

As a result, a motor vehicle door lock is provided, which is equipped with an opening as well as a closing function. Typically, the so-called "electrical opening" is used. The invention synergetically uses the opening drive in the event that an emergency interruption of closing function is required. In this case it is intended that the opening drive interrupts the mechanical connecting chain of the closing device. In detail, the opening drive ensures that the closing pawl of the closing device engaging with the rotary latch is lifted off said latch.

As during this process the pawl is typically and at the same time lifted in relation to the rotary latch, the rotary latch can, as a result, be pivoted by means of a spring and without mechanical blocking, thus releasing the previously engaged locking bolt. The same applies for a motor vehicle door interacting therewith. These are the main advantages.

The solution of the invention can be equally used for a locking mechanism consisting of a rotary latch and one or two pawls or for a multi-pawl locking mechanism, in which an additional blocking pawl is used for the pawls.

BRIEF DESCRIPTION OF THE DRAWINGS

Below, the invention is described in detail with reference to exemplary drawings showing only one embodiment, as follows.

Other features and advantages of the present invention will become apparent from the following detailed description, taken in conjunction with the accompanying drawings which illustrate, by way of example, the principles of the invention.

DETAILED DESCRIPTION OF THE INVENTION

The exemplary figures show a motor vehicle door lock equipped in the usual manner with a locking mechanism 1, 2 consisting of a rotary latch 1 and a pawl 2. As soon as the rotary latch 1 has assumed its main locking position shown in FIG. 2 or its closed position, the pawl 2 engages and blocks the rotary latch 1. In the shown example no latched connection occurs strictly speaking between the pawl 2 on one hand and the rotary latch 1 on the other hand in the main locking position or a preceding intermediate locking position. These terms should, however, be used for the below explanations. The main locking position is usually identified by a main closing position or closed position, whilst the intermediate locking position is part of an initial closed position.

Figure 2:
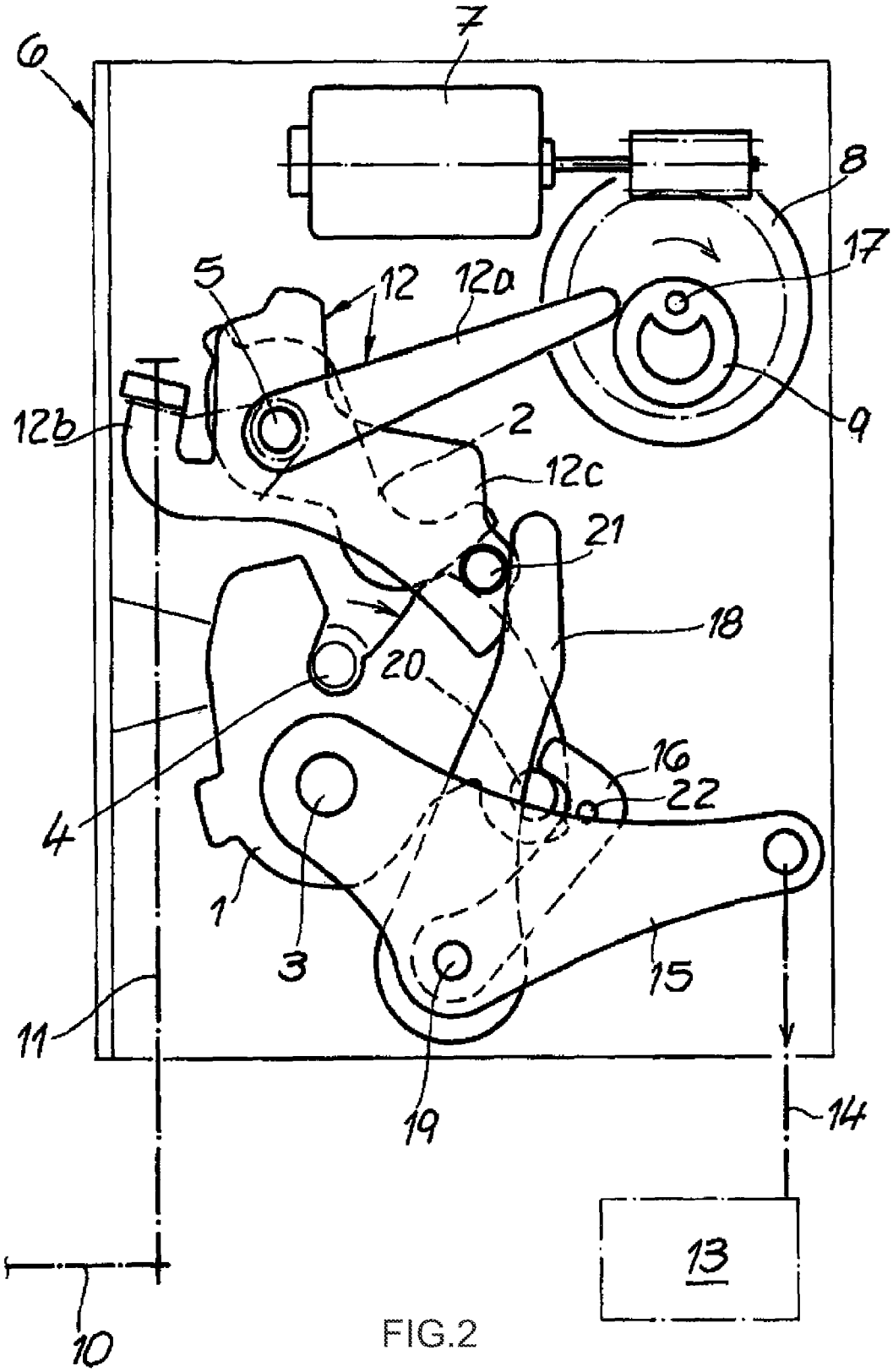
FIG. 2 shows the locking mechanism in the closed state.
Figure 3:
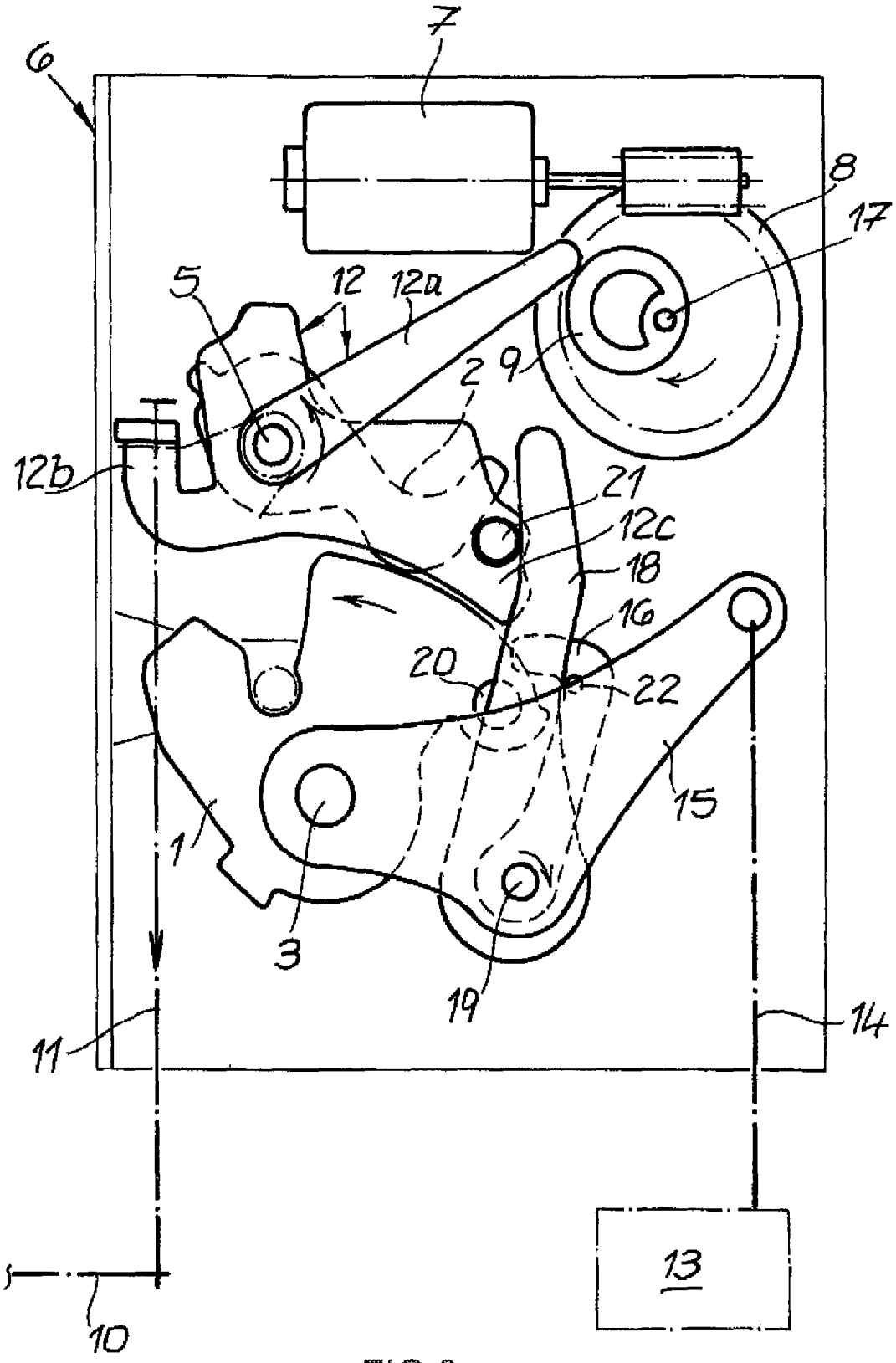
FIG. 3 shows the motor vehicle door lock according to FIG. 1 during the interruption of the closing function (emergency interruption).

Once the rotary latch 1 is no longer blocked by the pawl 2, the rotary latch 1 can mum anticlockwise around its axis 3 due to the force of the spring—not expressly shown—and assumes the open position. During this operation, a previously captured locking bolt 4, only indicated in FIG. 2, is released, which is mechanically connected to a motor vehicle door—not shown—in the usual manner. Some of this process is shown in FIG. 3.

The pawl 2 is rotatably mounted on an axis 5. The rotary latch 1 and the pawl 2 as well as the other elements of the motor vehicle door lock still to be described are all housed and mounted in an indicated lock case 6.

Of particular significance for the invention is a closing/opening device 7 to 16, comprising at least one drive 7 to 11 and 13, 14 one transfer element 12, 15 and one driving pawl 16. The at least one drive 7 to 11 and 13, 14 acts on the driving pawl 16 by means of the transfer element 12, 15. In this way, the locking mechanism 1, 2 can be opened or closed.

According to the invention, a mechanical opening drive 10, 11 and/or an electrical opening drive 7 to 9 and additionally a mechanical and/or electrical closing drive 13, 14 is provided. The mechanical opening drive 10, 11 and/or electrical opening drive 7 to 9 include a common opening transfer lever 12. In contrast, a closing transfer lever 15 is assigned to the mechanical and/or electrical closing drive 13, 14. Of particular significance is the circumstance that the opening drive 7 to 11 including the opening transfer lever 12 apart from providing the opening function for the locking mechanism 1, 2 also interrupt a closing function initiated by the closing drive 13, 14 in connection with the closing transfer lever 15.

To explain this further, the opening drive 7 to 11 is first of all explained in more detail. The opening drive 7 to 11 actually consists of the electrical opening drive 7 to 9 and the mechanical opening drive 10, 11. The electrical opening drive 7 to 9 has an electric motor 7, rotating a worm gear in the known manner with the aid of its drive shaft, said worm gear acting upon the circumference of the drive wheel 8. The drive wheel 8 is rotatably mounted around an axis 17 in the lock case 6.

The drive wheel 8 contains a cam 9. The cam 9 acts on the opening transfer lever 12 in the functional position shown in FIG. 3. Together with the opening transfer lever 12 the cam 9 also produces the opening function. In other words, the electrical opening drive 7 to 9 provides in connection with the opening transfer lever 12 the function "electric opening EO".

For this purpose, the drive wheel 8 of the electric motor 7 is acted upon in such a way that the drive wheel 8 starting from the function position shown in FIG. 2, the closed position of the locking mechanism 1, 2, makes a clockwise turn around axis 17. During this process, the cam 9 interacts with the opening transfer lever 12 or its drive arm 12*a*.

The opening transfer lever 12 comprises indeed the drive arm 12*a*, a connecting arm 12*b* and finally an actuating arm 12*c* n. As soon as the cam 9 acts upon the drive arm 12*a* of the at least two-arm opening transfer lever 12 by the described clockwise movement of the drive wheel 8 around axis 17, the opening transfer lever 12 is pivoted around its axis 5 in anticlockwise direction, as shown by a respective arrow. The opening transfer lever 12 is indeed arranged on the same axis as the pawl 2 on the common axis 5.

The anticlockwise movement of the opening transfer lever 12 around its axis 5, indicated in FIG. 3 by the arrow, causes the pawl 2 in the closed position, as shown in FIG. 2, to be lifted off the rotary latch 1. In order to achieve this, an actuating element 21, described in detail below, interacts with pawl 2 and lifts it off the rotary latch 1. As a result, the rotary latch 1 can assume its open position with the aid of the spring and release the previously retained locking bolt 4 and thus also a motor vehicle door. This process corresponds with the opening function or the already described "electrical opening EO".

The closing function is produced with the aid of the closing drive 13, 14. For this purpose, an electric motor 13, only shown schematically, acts on the transfer element 14, which in case of the example is a Bowden cable or another transfer element 14. During this process the Bowden cable 14 is in fact acted upon in such a way that the closing transfer lever 15 pivots around its axis 3 in clockwise direction as shown by the arrow indicated in FIG. 1.

Figure 1:
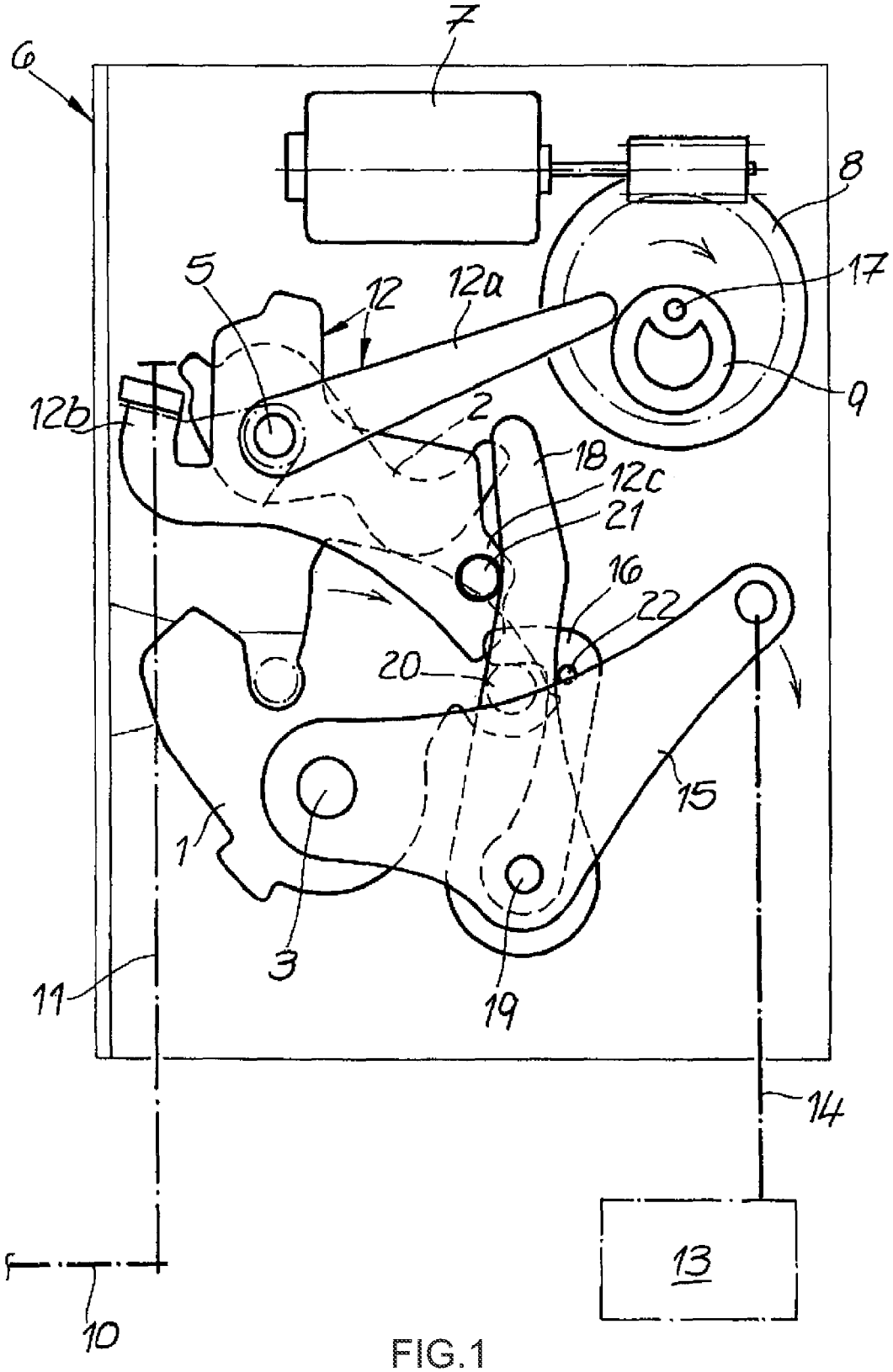
FIG. 1 shows the motor vehicle door lock of the invention during the closing process.

FIG. 1 actually shows the respective motor vehicle door lock during a closing operation.

As the closing pawl 16 is mounted on the same axis as the ejector lever 18 and together with the ejector lever 18 on the closing transfer lever 15 on a common axis 19, this process causes the rotary latch 1 during the transition from FIG. 1 to FIG. 2 to be moved into its main locking position or closed position as shown in FIG. 2.

Before, the closing pawl 16 extended around a journal 20 on the rotary latch 1, as soon as the rotary latch 1 has assumed its initial or intermediate locking position as shown in FIG. 1. As soon as, starting from this initial locking position, the closing transfer lever 15 is pivoted around its axis 3 in clockwise direction as indicated by the arrow, the closing pawl 16 also follows this pivot movement. As a result, the rotary latch 1 is also pivoted in clockwise direction around the common axis 3. This is indicated by an arrow in FIG. 1. In this way, the rotary latch 1 moves from its Initial locking position shown in FIG. 1 to the main locking position or closed position shown in FIG. 2.

The described closing process during the transition from the functional position of FIG. 1 to FIG. 2 can be interrupted. This is, for instance necessary, where a hand, finger or coat, etc. becomes jammed between the slowly closed motor vehicle door and the respective motor vehicle body. Typically, this is called an emergency interruption. To execute this emergency interruption in detail, the opening drive 7 to 11 ensures that the closing pawl 16 is ejected. This means that the mechanical connection from the closing drive 13, 14 to the closing transfer lever 15, the closing pawl 16 and up to the rotary latch 1 is interrupted with the aid of the opening drive 7 to 11.

For this purpose, the opening transfer lever 12 contains the aforementioned actuating element 21. The actuating element 21 ensures—as described—that during the opening function the pawl 2 is lifted off the rotary latch 1 of the locking mechanism 1, 2. In addition, the actuating element 21 is also designed to interrupt the closing function, as explained in detail below. The actuating element 21 does indeed interact either directly with the closing pawl 16 or via the upstream ejector lever 18 with the respective closing pawl 16 to interrupt the closing function, as shown in this embodiment.

The actuating element 21 is designed as an actuating journal extending vertically in comparison to the opening transfer lever 12. To interrupt the closing function, the actuating journal 21 arranged on the actuating arm 12*c* of the transfer lever 12 acts on the ejector lever 18 so that the closing pawl 16 is removed from its engagement with the rotary latch 1. At the same time, the actuating journal 21 ensures that the pawl 2 is lifted off the rotary latch 1. To initiate this process, a lever may be provided in a passenger compartment, not shown, acting as a mechanical opening drive 10, 11 and which mechanically engages with the opening transfer lever 12 via a coupling element 11. Alternatively, the opening transfer lever 12 can also be acted upon with the aid of an electrical opening drive 7 to 9.

The system functions as follows. As soon as the locking mechanism 1, 2 is pulled closed, the closing transfer lever 15 ensures that the closing pawl 16 follows this process. Indeed the closing transfer lever 15, the closing pawl 16 mounted on said lever and the rotary latch 1 turned as the closing pawl 16 abuts the journal 20 all pivot in clockwise direction. This also applies for the ejector lever 18. This process is shown in FIG. 1.

To interrupt the closing process, the opening transfer lever 12 in its entirety must carry out a pivoting movement around its axis 5 in anticlockwise direction, as shown in FIG. 3. This is either achieved with the aid of the cam 9 operated by the electric motor 7 or, by the fact, that the mechanical opening drive 10, 11 acts accordingly on the connecting arm 12*b* of the opening transfer lever 12 via the coupling element 11. In any case, each interruption of the closing process by the mechanical and/or electrical opening drive 7 to 11 corresponds with the opening transfer lever 12 carrying out the described anticlockwise pivoting movement around axis 5.

As a result, the actuating journal 21 acts on the ejector lever 18, pivoted clockwise around axis 19 shared with the closing pawl 16. During this process, the ejector lever 18 acts on a journal 22 on the closing pawl 16, so that the closing pawl 16 is lifted in its entirety off the journal 20 on the rotary latch 1. The rotary latch 1 is released (see arrow indicated in FIG. 3, indicating the associated anticlockwise movement of the rotary latch 1 around its axis 3). According to the invention, the ejector lever rests against the actuating journal 21 during the entire closing process, where applicable as a result of a spring force.

During the described process the actuating journal 21 ensures that the pawl 2 resting against the rotary latch 1 or engaging in the rotary latch 1 is lifted off the rotary latch 1. For this purpose, the end of the actuating journal 21 acts on the pawl 2, ensuring that pawl 2 pivots anticlockwise around axis 5. As a result, the pawl 2 is lifted off the rotary latch 1.

Both described processes occurring practically simultaneously, cause the rotary latch 1 to be opened by the force of a spring, by pivoting anticlockwise around its axis 3. As a result, the previously captured locking bolt 4 is released. The same applies to a motor vehicle door, not expressly shown, mechanically connected to the locking bolt 4.

This means that the interruption of the closing aid with the aid of the mechanical and/or electrical opening drive 7 to 11 also causes the pawl 2 to be lifted off the rotary latch 1. As a result, the rotary latch 1 can pivot upwards without colliding and through the force of a spring to release the locking bolt 4. This produces a direct and reliable emergency interruption of the closing function with the aid of the opening drive 7 to 11.

It is to be understood that the above-described embodiment is illustrative of only one of the many possible specific embodiments which can represent applications of the principles of the invention. Numerous and varied other arrangements can be readily devised by those skilled in the art without departing from the spirit and scope of the invention.

What is claimed is:

1. A motor vehicle door lock comprising:

a locking mechanism having a rotary latch and a pawl;

a driving pawl that rests on the rotary latch and is rotatable about an axis;

a mechanical and/or electrical opening drive;

a mechanical and/or electrical closing drive;

a closing transfer lever, wherein the closing drive acts on the closing transfer lever which acts on the driving pawl to rotate the rotary latch and close the locking mechanism;

an opening transfer lever that has an opening function for opening the locking mechanism and is also configured to interrupt a closing function initiated by the closing drive in connection with the closing transfer lever, wherein the opening transfer lever contains an actuating element that is configured as an actuating journal which during the opening function, lifts the pawl off the rotary latch of the locking mechanism; and an upstream ejector lever that is rotatable about the axis of the driving pawl, the upstream ejector lever being independently rotatable about the axis relative to the driving pawl, wherein during the interruption of the closing function, the actuating element is moved via rotation of the opening transfer lever to engage and rotate the upstream ejector lever and the upstream ejector lever rotates to engage the driving pawl and lift the driving pawl off of the rotary latch while, at the same time, the actuating element also engages the pawl to lift the pawl off the rotary latch.

2. The motor vehicle door lock according to claim 1, wherein the opening drive ejects the driving pawl in order to interrupt the closing function by means of the opening transfer lever.

3. The motor vehicle door lock according to claim 1, wherein the upstream ejector lever and the driving pawl are mounted on an axis of the closing transfer lever.

4. The motor vehicle door lock according to claim 1, wherein the opening transfer lever contains at least a drive arm and an actuating arm.

5. The motor vehicle door lock according to claim 1, wherein an electrical opening drive and a mechanical opening drive are provided.

6. The motor vehicle door lock according to claim 5, wherein the opening transfer lever interacts with a drive wheel of the electrical opening drive and/or a coupling element of the mechanical opening drive.

7. The motor vehicle door lock according to claim 6, wherein the drive wheel contains a cam acting upon a drive arm of the opening transfer lever.

8. The motor vehicle door lock according to claim 6, wherein the opening transfer lever interacts with the coupling element of the mechanical opening drive and the opening transfer lever is equipped with a connecting arm for the coupling element of the mechanical opening drive.

9. The motor vehicle door lock according to claim 1, wherein the opening drive is equipped with a lever accessible in a passenger compartment and/or an electrical switching element for actuating the opening drive.

* * * * *